US005539507A

United States Patent [19]

Miyashiro et al.

[11] Patent Number: 5,539,507

[45] Date of Patent: Jul. 23, 1996

[54] IMAGE FORMING APPARATUS HAVING TRANSFER MATERIAL BEARING MEMBER

[75] Inventors: Toshiaki Miyashiro, Ichikawa; Hiroshi Sasame, Yokohama; Tatsuya Kobayashi, Soka; Takehiko Suzuki, Yokohama, all of Japan

[73] Assignee: Canon Kabushiki Kaisha, Tokyo, Japan

[21] Appl. No.: 167,141

[22] Filed: Dec. 16, 1993

[30] Foreign Application Priority Data

Dec. 22, 1992 [JP] Japan ..... 4-356974

[51] Int. Cl.[6] ..... G03G 15/14

[52] U.S. Cl. ..... 355/271; 355/274

[58] Field of Search ..... 355/271, 272, 355/274, 275

[56] References Cited

U.S. PATENT DOCUMENTS

| | | | |
|---|---|---|---|
| 4,766,463 | 8/1988 | Watanuki et al. | 355/272 |
| 4,772,916 | 9/1988 | Mochida | 355/327 |
| 4,899,196 | 2/1990 | Mahoney | 355/271 |
| 5,132,736 | 7/1992 | Muramatsu et al. | 355/271 |
| 5,137,265 | 8/1992 | Sato et al. | 270/53 |
| 5,225,852 | 7/1993 | Uchida et al. | 346/134 |
| 5,249,023 | 9/1993 | Miyashiro et al. | 355/273 |
| 5,255,908 | 10/1993 | Hiroi et al. | 271/293 |
| 5,260,751 | 11/1993 | Inomata | 355/271 |

FOREIGN PATENT DOCUMENTS

| | | | |
|---|---|---|---|
| 281055 | 9/1988 | European Pat. Off. . | |
| 281138 | 9/1988 | European Pat. Off. . | |
| 368617 | 5/1990 | European Pat. Off. . | |
| 438303 | 7/1991 | European Pat. Off. . | |
| 480398 | 4/1992 | European Pat. Off. . | |
| 0125665 | 4/1992 | Japan | 355/274 |
| 0147158 | 5/1992 | Japan | 355/274 |
| 0053411 | 3/1993 | Japan | 355/274 |

*Primary Examiner*—Robert Beatty

*Attorney, Agent, or Firm*—Fitzpatrick, Cella, Harper & Scinto

[57] ABSTRACT

The present invention provides an image forming apparatus with an image bearing member for bearing an image, and a transfer material bearing member rotatable for bearing a transfer material. The image on the image bearing member is transferred onto the transfer material born by the transfer material bearing member at a transfer position, and a voltage is applied to the transfer material bearing member during the transferring of the transfer material. When a distance between the transfer position and a separation position where the transfer material is separated from the transfer material bearing member along a peripheral surface of the transfer material bearing member in a rotational direction of the transfer material bearing member is L, a whole circumferential length of the transfer material bearing member is L1 and a maximum length of the transfer material usable in the image forming apparatus in the rotational direction of the transfer material bearing member is Hmax, a relation $L \leqq (L1-Hmax)$ is satisfied.

50 Claims, 8 Drawing Sheets

IMAGE FORMING APPARATUS HAVING TRANSFER MATERIAL BEARING MEMBER

BACKGROUND OF THE INVENTION

1. Field of the Invention

The present invention relates to an image forming apparatus wherein an image formed on an image bearing member such as a photosensitive body, a dielectric body and the like is transferred onto a transfer material born by a transfer material bearing member, and more particularly it relates to a color image forming apparatus wherein a color image is formed by superposing plural color images on the same transfer material.

2. Related Background Art

Conventionally, various color image forming apparatuses have been proposed, and a typical full-color image forming apparatus of electrophotographic type is shown in FIG. 5. In FIG. 5, the color image forming apparatus has a cylindrical electrophotographic photosensitive body (photosensitive drum) 2 as an image bearing member. Around the photosensitive drum 2 rotated in a direction shown by the arrow, there are arranged a charge roller 4 for uniformly charging a surface of the photosensitive drum 2, and an exposure device 16 for forming an electrostatic latent image on the photosensitive drum 2 by using a light signal 17 emitted from a light source 16 such as a laser and the like. The electrostatic latent image formed on the photosensitive drum 2 is visualized (as a toner image) by a developing apparatus 5 having an yellow developing device 5*a* containing yellow (Y) color developer, a magenta developing device 5*b* containing magenta (M) color developer, a cyan developing device 5*c* containing cyan (C) color developer, and a black developing device 5*d* containing black (BK) color developer.

On the other hand, a transfer material 14 supplied one by one from a sheet supply cassette is held by a transfer drum (transfer material bearing member) 31 having a gripper 15, and the toner image formed on the photosensitive drum 2 is transferred onto the transfer material at a transfer station.

After the image is transferred to the transfer material 14, the residual toner remaining on the photosensitive drum 2 is removed by a cleaning means (cleaner) 6 for the preparation for the next image formation. In this way, for example, four color toner images are transferred onto the same transfer material in a superposed fashion. Thereafter, the transfer material is separated from the transfer drum 31 by a separation means 3, and then is sent to a fixing device 12, where the transferred toner images are fixed to the transfer material 14.

In the apparatus shown in FIG. 5, as shown in FIG. 6A, the transfer drum 31 comprises both end rings 1*a*, and a connection member 31*b* connecting between these end rings 31*a* to form a hollow notched drum frame or box. A notched portion or opening of the drum frame is enclosed by a flexible dielectric sheet 1*c* made of polyethylene telephthalate (PET), polyvinylidene fluoride (PVdF), ethylene propylene fluoride copolymer (FEP), polycarbonate, polyurethane or the like, thereby forming the transfer drum.

Further, as shown in FIG. 5, an attraction roller for electrostatically attracting the transfer material 14 to the flexible sheet 31*c* is arranged outside the transfer drum 31. In addition, within the transfer drum 31, along a rotational direction of the drum, there are arranged a attraction charger 8 opposed to the attraction roller 7 and adapted to charge the flexible sheet 31*c*, and a transfer charger 9 disposed at the transfer station. Further, there are also arranged separation electricity removal chargers 10 for removing the electricity from the transfer material absorbed to the flexible sheet 31*c*, a separation pawl 3 for separating the transfer material 14 from the transfer drum 31, and a sheet electricity removal charger 11 for initializing the potential of the flexible sheet 31*c*.

Explaining the image formation process of the color image forming apparatus, first of all, a first color electrostatic latent image formed on the photosensitive drum 2 by the exposure light 17 in response to a first color image signal from the exposure device 16 is visualized by the yellow developing device 5*a* containing the yellow (Y) developer. In a timed relation to this process, the transfer drum 31 holds a tip end (leading end) of the transfer material 14 by the gripper 15, and then the transfer material 14 is pinched between the attraction roller 7 and the transfer drum 31 and at the same time the transfer material 14 is electrostatically absorbed to the surface of the transfer drum by applying the charges from the attraction charger 8 to the back surface of the flexible sheet 31*c* of the transfer drum 31.

The transfer material 14 held by the transfer drum 31 is conveyed to the image transfer station (opposed to the photosensitive drum 2) by the rotation of the transfer drum, where the image formed on the photosensitive drum 2 is transferred onto the transfer material by the action of the transfer charger 9.

Thereafter, the residual developer remaining on the photosensitive drum 2 is removed by the cleaner 6, and then, a new electrostatic latent image is formed on the photosensitive drum 2 by the exposure device 16 in response to a second color image signal. This electrostatic latent image is developed by the magenta developing device 5*b* containing the magenta (M) developer corresponding to the second color, thereby obtaining the visualized image. This second color visualized image is transferred onto the transfer material 14 to which the first color visualized image was transferred by the transfer charger 9. Similarly, a third color visualized image is formed on the photosensitive drum 2 by using the cyan (C) developer and the visualized image is transferred onto the transfer material 14 on the transfer drum 31 in a superposed fashion in the same manner as the second color visualized image. Lastly, a fourth color visualized image is formed on the photosensitive drum 2 by using the black (BK) developer and the visualized image is transferred onto the same transfer material 14 on the transfer drum 31 in a superposed fashion in the same manner as the third color visualized image.

The transfer material 14 to which the plural color visualized images were transferred is sent, by the rotation of the transfer drum 31, to the separation electricity removal chargers 10 opposed to each other with the interposition of the flexible sheet 31*c*. Accordingly, the electrostatic attraction force between the transfer material 14 and the flexible sheet 31*c* is removed, and then the transfer material 14 is separated from the transfer drum 31 by the separation pawl 3. The separated transfer material 14 is sent to the fixing device 12, where the transferred visualized images are fixed to the transfer material. After the transfer material is separated, the charge on transfer drum 31 is removed by the sheet electricity removal charger 11 to electrically initialize the transfer drum 31. FIG. 9 shows the image formation sequence wherein images are formed continuously with respect to a plurality of transfer materials.

In the above explanation, while an example that the notched transfer drum is used as the transfer drum 31 was explained, as shown in FIG. 6B, it is well known to use a solid transfer drum having no notch, which is constituted by a conductive base or cylindrical drum frame la, an elastic layer l*b* made of foam material such as urethan foam, CR rubber, EPDM rubber, silicone rubber or the like and coated on the drum frame, and a flexible sheet l*c* coated on the elastic layer. In this case, the bias voltage is applied to the solid drum 1.

Since the transfer drum 1 of solid drum type can be simplified in its internal construction in comparison with the above-mentioned notched drum 1, the drum can be made cheaper, and, since the flexible sheet l*c* is supported from inside, it is possible to reduce or eliminate the deformation- and damage of the flexible sheet which is the drawback regarding the notched drum. The color image forming apparatus using such transfer drum of solid drum type has the durability longer than that using the notched transfer drum and can reduce the number of chargers (to be used) which generate ozone. Accordingly, nowadays, color image forming apparatuses using the solid transfer drum have been noticed.

However, in case where the solid drum as shown in FIG. 6B is used as a transfer drum, when the sequence as shown in FIG. 9 is effected, immediately before the transfer material is separated from the transfer drum, it is feared that the toner image(s) on the transfer material is scattered to distort the image. This is the reason why, since the transfer voltage for the first color differs from the transfer voltage for the fourth color, immediately after the fourth color image is transferred, when the transfer voltage for the fourth color is charged to the transfer voltage for the first color, the attraction force for absorbing the toner image to the transfer material is reduced or disappeared before the separation of the transfer material. Further, in order to prevent the distortion of the image when the images are continuously formed on a plurality of transfer materials, if a distance between a first transfer material and a second transfer material is made longer, the number of revolutions of the transfer drum is increased, thereby worsening the productivity and reducing the durability of the apparatus.

SUMMARY OF THE INVENTION

An object of the present invention is to provide an image forming apparatus which can prevent the distortion of an image due to the scattering of toner.

Another object of the present invention is to provide an image forming apparatus which can form a good image.

A further object of the present invention is to provide an image forming apparatus which can improve the productivity.

A still further object of the present invention is to provide an image forming apparatus which can eliminate the useless rotation of a transfer material bearing member, thereby improving the durability of the apparatus.

The other objects and features of the present invention will be apparent from the following explanation referring to the accompanying drawings.

DETAILED DESCRIPTION OF THE PREFERRED EMBODIMENTS

The present invention will now be fully explained with reference to the accompanying drawings.

Figure 1:
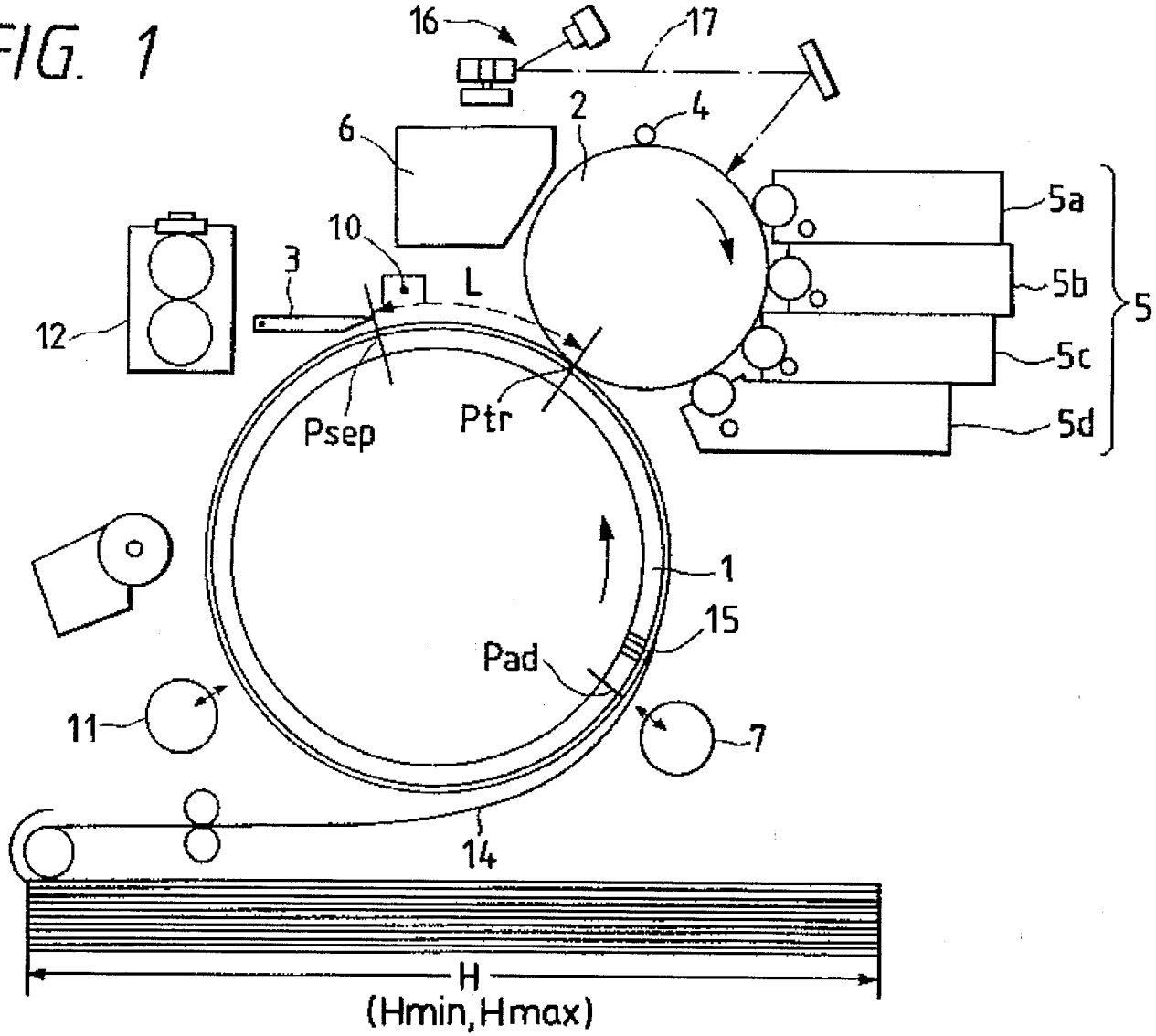
FIG. 1 is a schematic constructural view of a color image forming apparatus according to a preferred embodiment of the present invention.

FIG. 1 is a schematic sectional view of a color image forming apparatus to which the present invention is applied.

In this embodiment, the color image forming apparatus has a cylindrical electrophotographic photosensitive body (photosensitive drum) 2 as an image bearing member. The photosensitive drum comprises a photosensitive layer, and conductive base electrically earthed and adapted to support the photosensitive layer. Around the photosensitive drum 2 rotated in a direction shown by the arrow, there are arranged a charge roller 4 for uniformly charging a surface of the photosensitive drum 2, and an exposure device 16 for forming an electrostatic latent image on the photosensitive drum 2 by using a light signal 17 emitted from a light source 16 such as a laser and the like. The electrostatic latent image formed on the photosensitive drum 2 is visualized (as a toner image) by a developing apparatus 5 having an yellow developing device 5a containing yellow (Y) color developer, a magenta developing device 5*b* containing magenta (M) color developer, a cyan developing device 5*c* containing cyan (C) color developer, and a black developing device 5*d* containing black (BK) color developer.

On the other hand, a transfer material 14 supplied one by one from a sheet supply cassette is held by a transfer drum (transfer material bearing member) 1 having a gripper 15, and the toner image formed on the photosensitive drum 2 is transferred onto the transfer material at a transfer station.

After the image is transferred to the transfer material 14, the residual toner remaining on the photosensitive drum 2 is removed by a cleaning means (cleaner) 6 for the preparation for the next image formation. In this way, for example, four color toner images are transferred onto the same transfer material in a superposed fashion. Thereafter, the transfer material is separated from the transfer drum 1 by a separation means 3, and then is sent to a fixing device 12, where the transferred toner images are fixed to the transfer material 14.

Figure 6A:
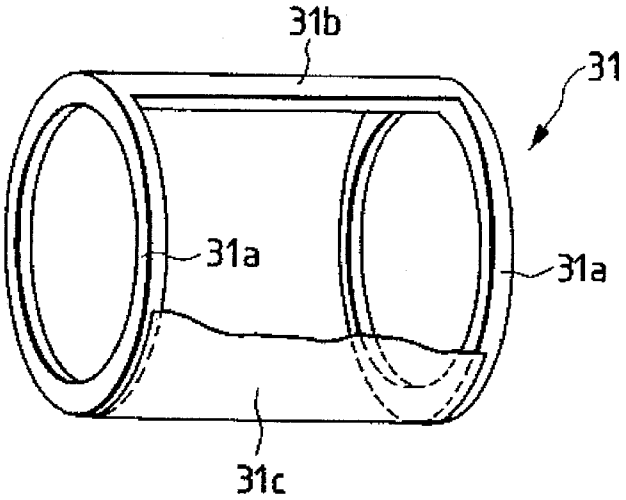
FIG. 6A PRIOR ART
FIG. 6A is a perspective view of a notched drum.
Figure 6B:
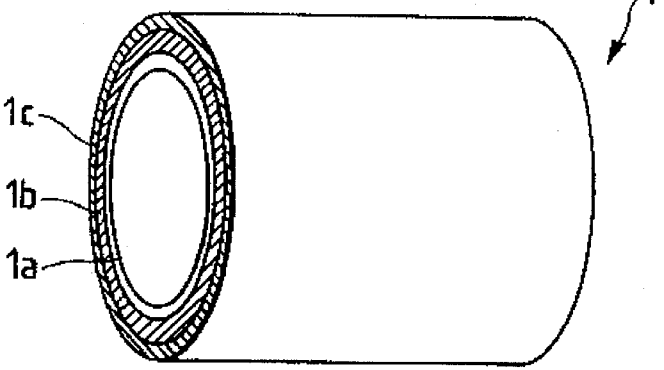
FIG. 6B PRIOR ART
FIG. 6B is a perspective view of a solid drum.

As shown in FIG. 6B, the transfer drum 1 is constituted by a conductive base or cylindrical drum frame l*a*, an elastic layer l*b* made of foam material such as urethane foam, CR rubber, EPDM rubber, silicone rubber or the like and coated on the drum frame, and a flexible sheet 1*c* coated on the elastic layer. The transfer drum 1 has the frame la, elastic layer l*b* and sheet l*c* in at least an area where the transfer material can be born by the drum, and the frame la is connected to a DC electric source.

Further, in the illustrated embodiment, a attraction roller 7 for electrostatically absorbing the transfer material 14 to the flexible sheet 1*c* is arranged outside the transfer drum 1. In addition, there are arranged a separation electricity removal charger 10 for removing the electricity from the transfer material 14 absorbed to the flexible sheet l*c*, a separation pawl 3 for separating the transfer material 14 from the transfer drum 1, and a sheet electricity removal charger 11 for initializing the potential of the flexible sheet l*c*.

Further, explaining the image formation process of the color image forming apparatus, first of all, a first color electrostatic latent image formed on the photosensitive drum 2 by the exposure light 17 in response to a first color image signal from the exposure device 16 is visualized by the yellow developing device 5*a* containing the yellow (Y) developer. In a timed relation to this process, the transfer drum 1 holds a tip end (leading end) of the transfer material 14 by the gripper 15, and then the transfer material 14 is pinched between the attraction roller 7 and the transfer drum 1 and at the same time the transfer material 14 is electrostatically absorbed to the transfer drum 1 due to the charges generated by applying the attraction bias voltage to the drum frame 1*a* and the attraction roller 7.

The transfer material 14 held by the transfer drum 1 is conveyed to the image transfer station (opposed to the photosensitive drum 2) by the rotation of the transfer drum 1, where the image formed on the photosensitive drum 2 is transferred onto the transfer material. During the transfer operation, the transfer voltage is applied to the from frame l*a*.

Thereafter, the residual developer remaining on the photosensitive drum 2 is removed by the cleaner 6, and then, a new electrostatic latent image is formed on the photosensitive drum 2 by the exposure device 16 in response to a second color image signal. This electrostatic latent image is developed by the magenta developing device 5*b* containing the magenta (M) developer corresponding to the second color, thereby obtaining the visualized image. This second color visualized image is again transferred onto the transfer material 14 to which the first color visualized image was transferred. Similarly, a third color visualized image is formed on the photosensitive drum 2 by using the cyan (C) developer and the visualized image is transferred onto the transfer material 14 on the transfer drum 1 in a superposed fashion in the same manner as the second color visualized image. Lastly, a fourth color visualized image is formed on the photosensitive drum 2 by using the black (BK) developer and the visualized image is transferred onto the same transfer material 14 on the transfer drum 1 in a superposed fashion in the same manner as the third color visualized image.

When the second color visualized image is transferred, the value of the transfer voltage is changed to correct the potential dropped due to the transferring of the first color visualized image to the transfer material 14 on the transfer drum 1. Such correction is also effected in the transferring operations regarding the third and fourth color visualized images. That is to say, the value of the transfer voltage applied to the drum frame 1*a* is gradually increased from the first color to the fourth color.

The transfer material 14 to which the plural color visualized images were transferred is sent, by the rotation of the transfer drum 1, to the separation electricity removal charger 10 disposed outside the transfer drum 1, where the electrostatic attraction force between the transfer material 14 and the flexible sheet 31*c* is removed. Then, the transfer material 14 and the flexible sheet 31*c* is removed. Then, the transfer material 14 is separated from the transfer drum 1 by the separation pawl 3. The separated transfer material 14 is sent to the fixing device 12, where the plural color toner images are fixed to the transfer material while being fused and mixed. After the transfer material is separated, the charge on transfer drum 1 is removed by the sheet electricity removal charger 11 to electrically initialize the transfer drum 1.

Figure 7:
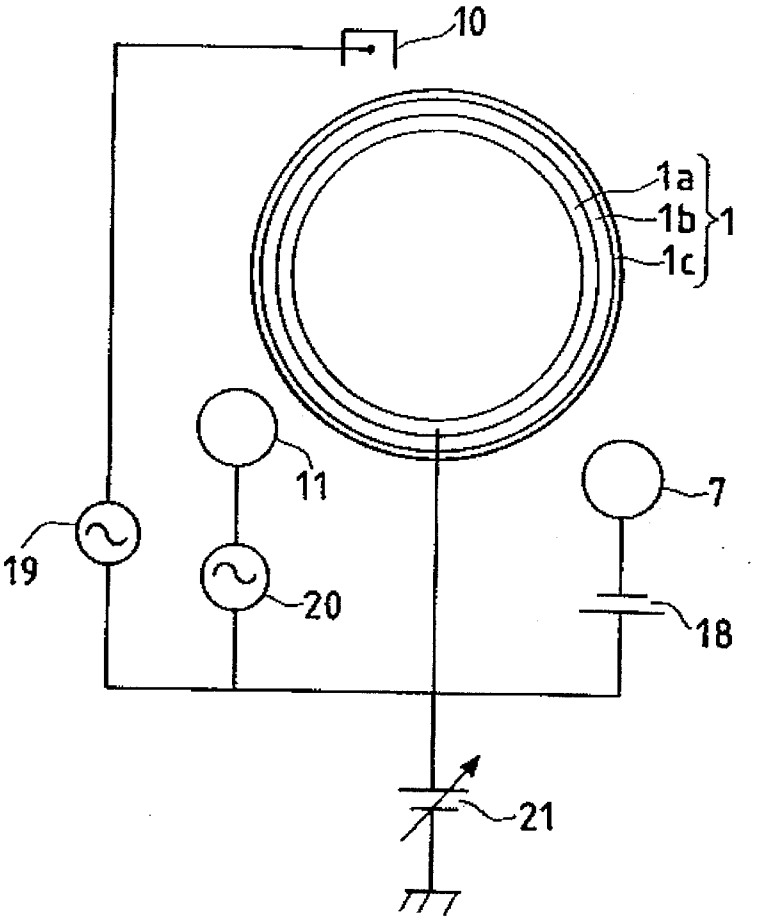
FIG. 7 is a view showing the arrangement of chargers and an electricity removal charger around the solid drum.

Further, in the color image forming apparatus using the above-mentioned solid drum, since the solid drum frame 1*a* also acts as a common counterelectrode for the attraction roller 7, separation electricity removal charger 10 and sheet electricity removal charger 11, as shown in FIG. 7, an attraction bias power source 18, a separation bias power source 19 and an electricity removal bias power source 20 (each of which uses the output potential of a transfer bias power source 21 associated with the solid drum 1 as the reference potential) are connected to the attraction roller 7, separation electricity removal charger 10 and sheet electricity removal charger 11, respectively. Accordingly, the voltage applied between the drum frame 1*a* and the attraction roller 7, the voltage applied between the drum frame la and the separation electricity removal charger 10, and the voltage applied between the drum frame 1*a* and the sheet electricity removal charger 11 are not influenced upon the change in the output potential of the transfer bias power source 21.

Next, in the apparatus shown in FIG. 1, when it is assumed that a distance between the transfer station Ptr and the separation station Psep along the peripheral surface of the transfer drum 1 in a rotational direction of the transfer drum 1 is L, a whole circumferential length of the transfer drum 1 is L1 and a minimum length (along the rotational direction of the transfer drum 1) of the transfer material usable in this apparatus is Hmin, a condition which satisfys the following relation (1) will be explained:

$$L>(L1-Hmin) \quad (1)$$

Figure 9:
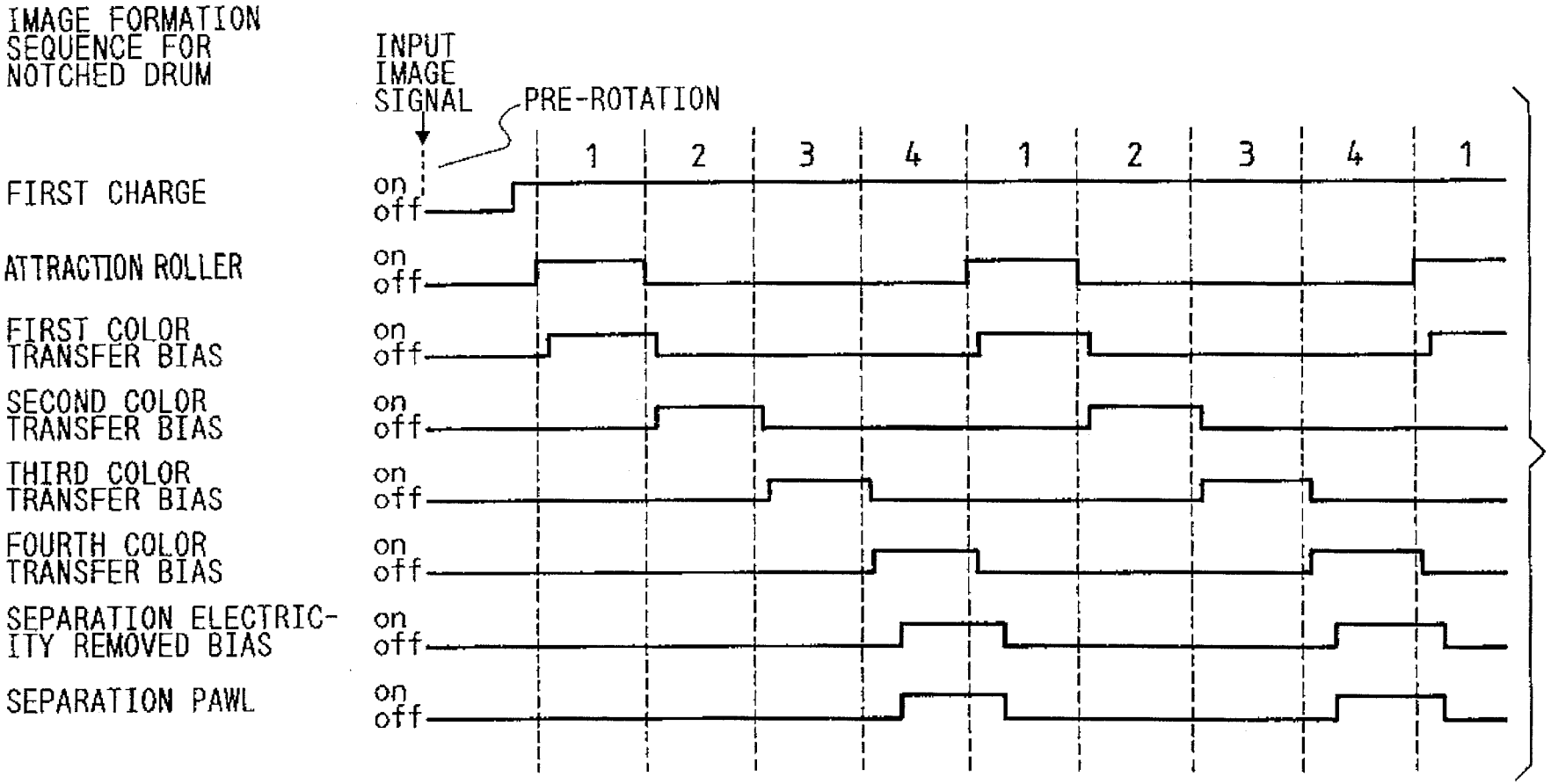
FIG. 9 is an image formation sequence, when the notched drum is used.

In case where the relation (1) is satisfied, when the images are continuously formed with respect to a plurality of transfer materials (that is, when the images are formed on a plurality of transfer materials in response to one image signal of the apparatus), unlike to the case shown in FIG. 9, it is impossible to form the image on the single transfer material during four revolutions of the transfer drum. That is to say, it is necessary to rotate the transfer drum by five revolutions for forming the image on the single transfer material. The reason will be described hereinbelow.

Figure 5:
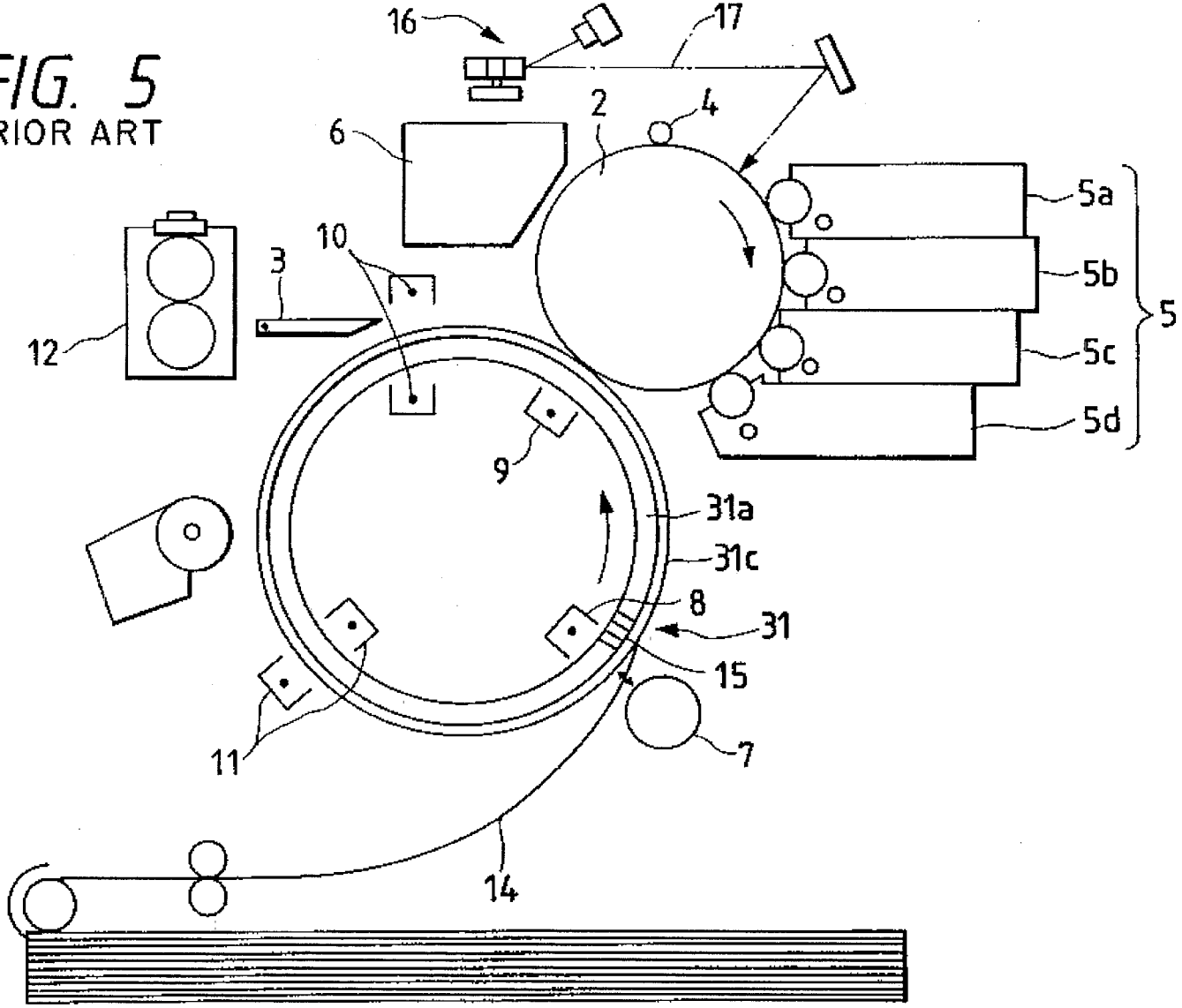
FIG. 5 PRIOR ART
FIG. 5 is a schematic constructural view of a conventional color image forming apparatus.

As explained in connection with FIGS. 5 and 9, when the notched drum 31 is used, the attraction charger 8, transfer charger 9, separation electricity removal chargers 10 and sheet electricity removal charger 11 (including their counterelectrodes) are independently constructed, respectively. Thus, these chargers can independently apply the different charges to the flexible sheet 31*c* of the notched drum 31, respectively, and accordingly, the visualized image formed on the transfer material 14 on the notched drum 31 is held by the independent charges on the back surface of the flexible sheet 31*c*.

To the contrary, when the solid drum 1 is used, the potential of the flexible sheet l*c* of the surface of the solid drum 1 is increased by changing the transfer bias voltage applied to the conductive drum frame l*a*, and the visualized image is held on the transfer material 14 by continuously applying such transfer bias voltage. Thus, in the solid drum 1, the transfer bias voltage is increased per one revolution of the drum from the first color to the fourth color, and particularly, the transfer bias voltage for the fourth color continues to be applied until the transfer material 14 is separated from the solid drum 1, because of the prevention of the scattering of the image. Otherwise (that is, if the bias voltage value of the transfer bias voltage is decreased immediately after the fourth color visualized image is transferred), the attraction force for holding the transfer material 14 on the solid drum 1 will be disappeared before the separation of the transfer material, so that the developer (toner) absorbed to the transfer material 14 by the transfer bias voltage is scattered to cause the scattering of the image.

In this way, when the solid drum 1 is used, since the transfer bias voltage is being applied until the separation of the transfer material 14 is finished, the next first color visualized-image cannot be transferred onto a next transfer material until the separation of the previous transfer material 14 is finished.

Figure 8:
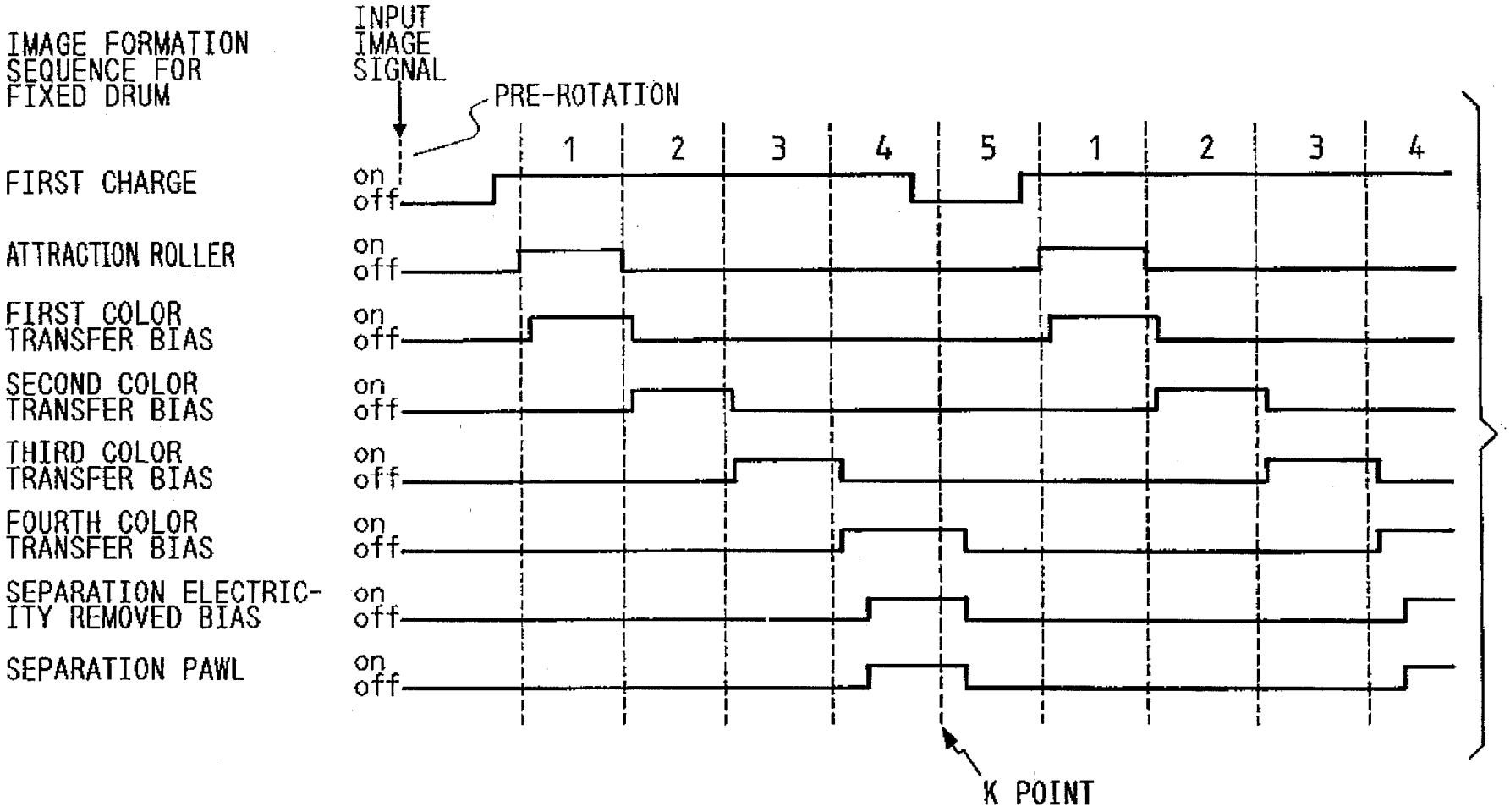
FIG. 8 is an image formation sequence for solid drum five (5) rotation, when the solid drum is used.

Accordingly, as shown in FIG. 8, if the next transfer material 14 is held at a K point, the next first color visualized image will be transferred with the transfer bias voltage for the fourth color. Incidentally, the K point means a time when a position for holding the tip end of the transfer material corresponds to the attraction position of the attraction roller. Therefore, when the solid drum 1 is used, if it is arranged in the same manner as the notched drum, as shown in FIG. 8, at least one revolution of the transfer drum will be required after the image formation. That is to say, in case of FIG. 8, a distance between a certain transfer material and a next transfer material will be longer in comparison with the case of FIG. 9.

As mentioned above, in the color image forming apparatus using the solid drum and satisfying the relation (1), the number of revolutions of the transfer drum 1 required for forming one image is increased in comparison with the apparatus using the notched drum, and accordingly, the number of revolutions of the photosensitive drum (image bearing member) 2 rotated while opposing to the transfer drum 1 is also increased in comparison with the apparatus using the notched drum. Thus, in the color image forming apparatus using the solid drum, there arose the disadvantage that the photosensitive drum and the cleaning means contacted with the photosensitive drum are deteriorated faster than the apparatus using the notched drum, since the photosensitive drum and the cleaning means are subjected to the greater load than that of the apparatus using the notched drum.

Accordingly, when the images are continuously formed with respect to a plurality of transfer materials, in order to reduce a distance between a certain transfer material and a next transfer material as much as possible, the following relation (2) may be satisfied.

$$L \leqq (L1 - Hmax) \quad (2)$$

That is to say, the relationship between a distance (L) from the transfer position Ptr to the transfer material separation position Psep (where the separation pawl 3 is opposed to the solid drum 1) along the peripheral surface of the solid drum 1 in a rotational direction of the solid drum 1, a whole circumferential length (L1) of the solid drum 1, and maximum length (Hmax) of the transfer material 14 (along the rotational direction of the drum 1) usable in the apparatus may be selected to satisfy the relation (2).

Incidentally, when a radius of the transfer drum is R, L1 becomes $2\pi R$. In case where the relation (2) is satisfied, when the images are continuously formed with respect to the plurality of transfer materials, immediately after the first transfer material has been separated, a tip end of the second transfer material does not yet reach the transfer station. That is to say, when the transferring process of the first color image to the second transfer material (i.e., process for transferring the first color visualized image formed on the photosensitive drum 2 onto the second transfer material) is started, the separation of the first transfer material 14 has already been finished, and, thus, only one transfer material is always held on the solid drum 1. Therefore, after the second transfer material 14 is held at the point K in FIG. 8, the voltage value of the transfer bias voltage can be changed from the transfer bias voltage value for the fourth color to the transfer bias voltage value for the first color immediately before the tip end of the second transfer material 14 enters into the image transfer position Ptr. Of course, a time point T2 for changing the transfer bias voltage may be positioned between a time point T1 when the separation of the previous transfer material 14 from the solid drum 1 is finished and a time point T3 when the tip end of the next transfer material 14 enters into the image transfer position Ptr.

Figure 2:
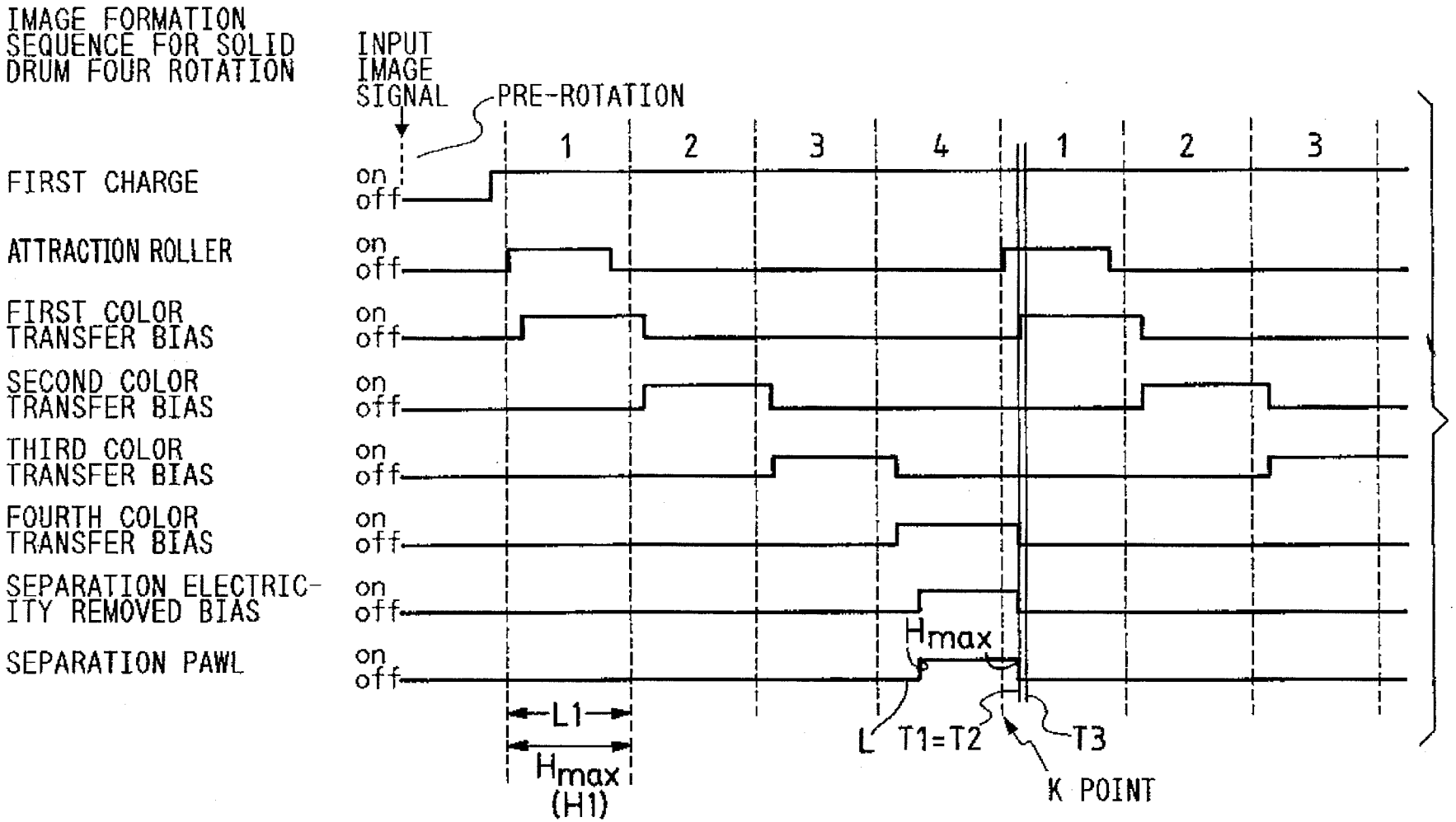
FIG. 2 is an image formation sequence for solid drum four (4) rotation, for carrying out the present invention.

An example of the image formation sequence for carrying out the present invention is shown in FIG. 2.

In this embodiment, the time point T2 for changing the transfer bias voltage is in coincident with the time point T1 when the previous transfer material 14 has just been separated from the solid drum 1 (that is, T1=T2).

In the above relation (2), it should be noted that the shorter the distance L between the image transfer position Ptr (where the photosensitive drum 2 is opposed to the solid drum 1) and the transfer material separation position Psep (where the separation pawl 3 is opposed to the solid drum 1) along the peripheral surface of the solid drum 1 in the rotational direction of the solid drum 1, the smaller the solid drum 1. L=0 is most desirable. Preferably, the value L in the above relation (2) is in a range of $0<L<L1/5$.

In order to make the apparatus further small-sized to improve the productivity, it is desirable that a distance between the separation position Psep and a transfer material being position (attraction position) Pad along the peripheral surface of the solid drum 1 in the rotational direction of the solid drum 1 is made smaller than Hmax. That is to say, it is desirable that the next transfer material is held by the solid drum before the separation of a certain transfer material from the solid drum is finished during the continuous image formation.

Further, when L=0 is established, the load to the photosensitive drum 2 and the cleaning means 6 is minimized. Further, in case where the process speed is constant, when L=0 is established, it is apparent that the number of transfer materials on which the images were formed is maximized. When L>0, in order to obtain the same number of imaged transfer materials, the image formation process speed must be increased as the distance L is increased.

Figure 3:
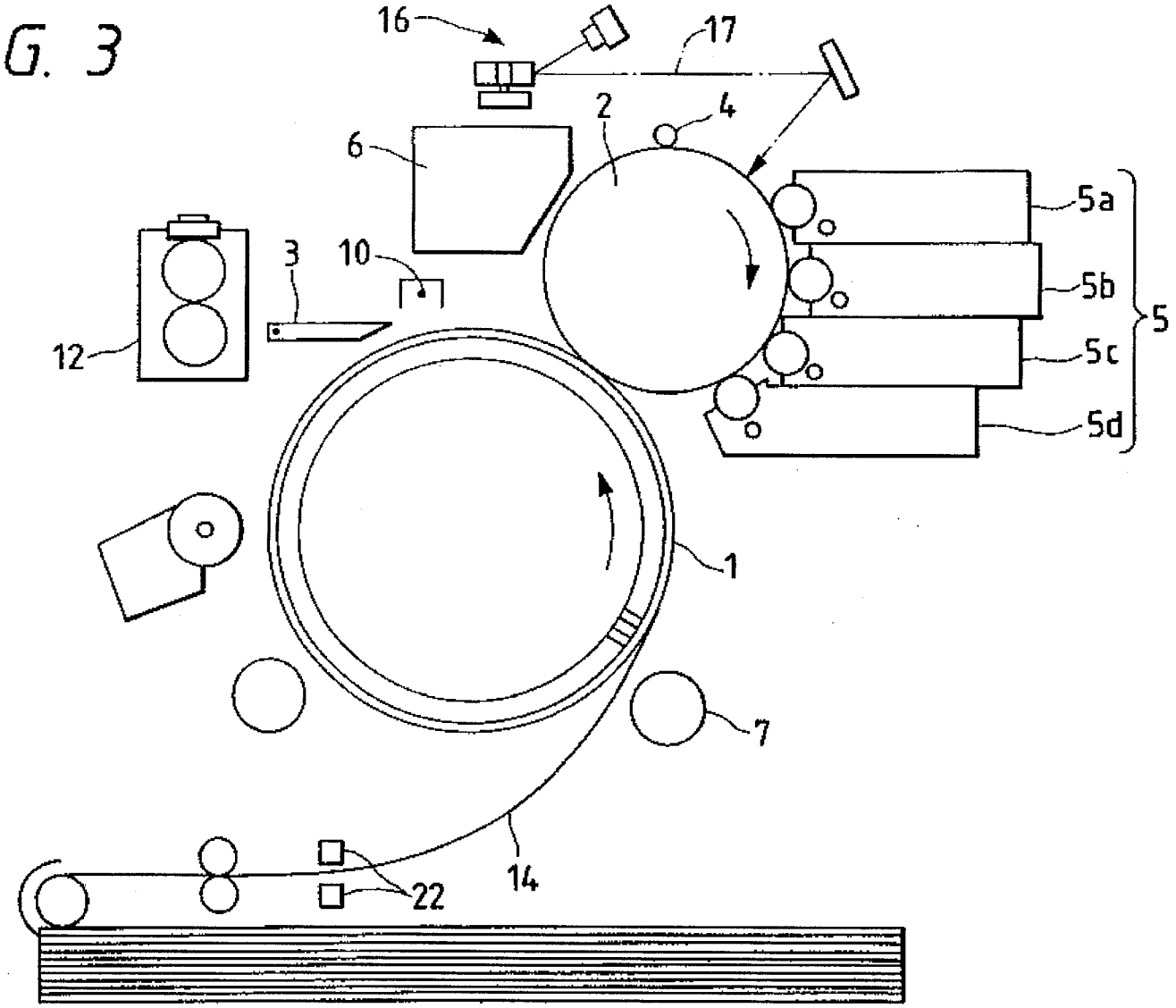
FIG. 3 is a schematic constructural view of a color image forming apparatus according to another embodiment of the present invention.

FIG. 3 shows a color image forming apparatus according to another embodiment of the present invention. Since the fundamental construction of the color image forming apparatus according to this embodiment is substantially the same as that of the apparatus according to the embodiment shown in FIG. 1, only the differences will be explained. In this embodiment, the arrangement of the solid drum 1, photosensitive drum 2 and separation pawl 3 does not satisfy the above relation (2).

Normally, when the maximum length (Hmax) of the transfer material 14 usable in the color image forming apparatus is, for example, A3 size, transfer materials having A4 size and B4 size can naturally be used. In this case, when the transfer material has A3 size (Hmax), even if the above relation (2) is not satisfied, that is, even if a relation $$L>L1-Hmax \quad (3)$$

is established, when the transfer material 14 of A4 size is used, the following relation (4) may be satisfied.

$$L\leqq L1-Hmin \quad (4)$$

where, Hmin is a length of the transfer material 14 of A4 size in the rotational direction of the transfer drum.

Accordingly, by detecting the size of the transfer material 14 selected in the image formation, when the length (Hmin) of the transfer material satisfies the relation (4), the image formation by using the solid drum four (4) rotation can be carried out, that is, the image formation sequence shown in FIG. 2 can be adopted.

Figure 4:
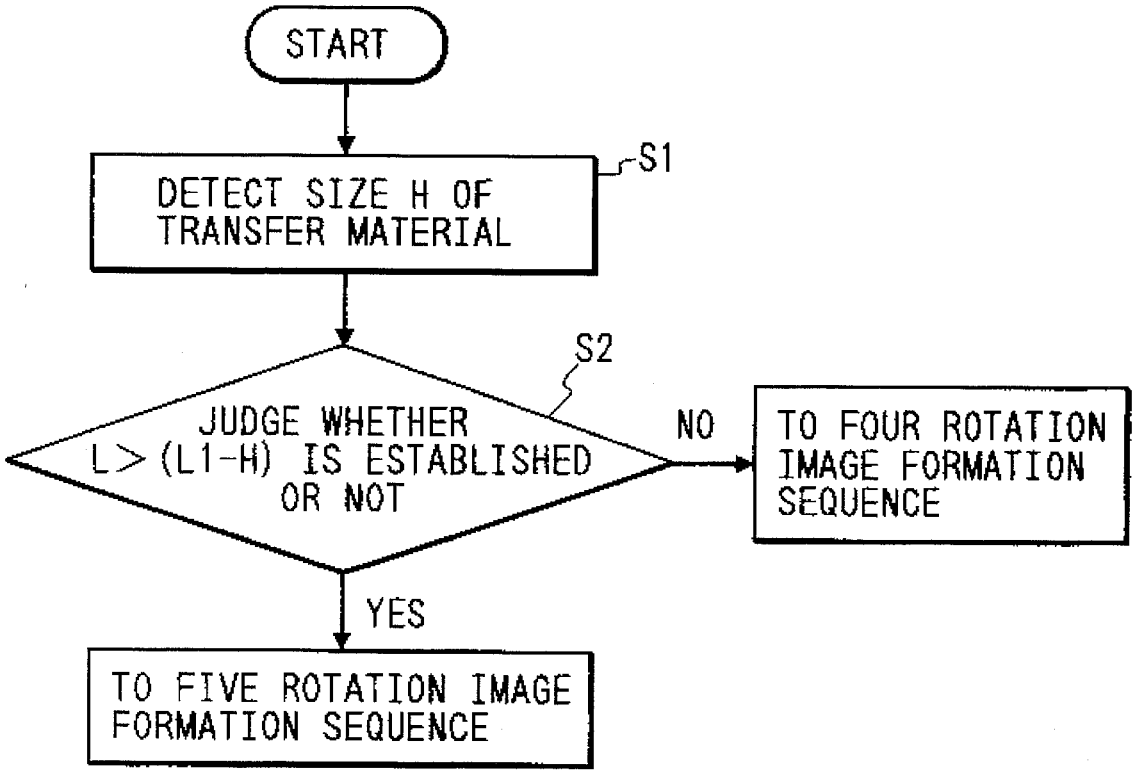
FIG. 4 is a control flow chart, for carrying out the present invention.

In the embodiment shown in FIG. 3, an optical or mechanical sensor 22 is arranged in a transfer material convey path, so that the image formation can be effected on the basis of a control flow chart shown in FIG. 4. That is to say, the sensor 22 detects the time when the transfer material 14 passes through the sensor, and the length H of the transfer material in a conveying direction of the transfer material is calculated (step S1). If the length H of the transfer material satisfies the above relation (4) ("NO" in a step S2 in FIG. 4), the image formation is effected by using the image formation sequence for solid drum 4 rotation (refer to FIG. 2) described in connection with the aforementioned embodiment. On the other hand, if the length H of the transfer material 14 does not satisfy the above relation (4) ("YES" in the step S2 in FIG. 4), the image formation is effected by using the image formation sequence for solid drum 5 rotation as shown in FIG. 8.

In this way, according to this embodiment, even if the arrangement of the apparatus does not satisfy the above relation (2), since it is not necessary to perform the image formation by using the image formation sequence for solid drum 5 rotation (which applies the great load to the photosensitive drum and the cleaning means) for all of the transfer materials 14 having various sizes, it is possible to reduce the load applied to the photosensitive drum and the cleaning means in comparison with the conventional color image forming apparatuses.

In this embodiment, while an example that the length H of the transfer material 14 is detected in the transfer material convey path was explained, the present invention is not limited to this example, but, since the length H of the transfer material can be detected, other conventional detection means may be used. Further, the image formation process speed (speed of the image bearing member) in the image formation sequence for solid drum 4 rotation may be differentiated from the process speed in the image formation sequence for solid drum 5 rotation. For example, it is preferable that the process speed of the image formation sequence for solid drum 4 rotation is made slower than that of the image formation sequence for solid drum 5 rotation by one revolution, since the load to the photosensitive drum and the cleaning means can be further reduced. Of course, it should be noted that, when the process speed of the image formation sequence for solid drum 4 rotation is the same as that of the image formation sequence for solid drum 5 rotation, the number of imaged transfer materials per time unit in the image formation sequence for solid drum 4 rotation is greater than that in the image formation sequence for solid drum 5 rotation.

While the present invention was explained in connection with particular embodiments, the present invention is not limited to such embodiments, but, various alterations and modifications can be effected within the scope of the present invention.

What is claimed is:

1. An image forming apparatus, comprising:

an image bearing member for bearing an image thereon; and a transfer material bearing member rotatable for bearing a transfer material, said transfer material bearing member comprising a sheet member for bearing the transfer material, and a conductive member disposed on a side of the sheet member opposite to a side where the sheet member bears the transfer material and to which a voltage is applied for transferring the image of said image bearing member to the transfer material born on said sheet member at a transfer position during the transferring operation to the transfer material;

characterized by that when defining a distance between the transfer position and a separation position where the transfer material is separated from said transfer material bearing member along a peripheral surface of said transfer material bearing member in a rotational direction as L, a whole circumferential length of said transfer material bearing member as L1, and a maximum length of the transfer material usable in said image forming apparatus in the rotational direction of the transfer material bearing member as Hmax, a relation $L\leqq(L1-Hmax)$ is satisfied.

2. An image forming apparatus according to claim 1, wherein a constant voltage is applied to said conductive member during a time period from immediately before the transfer material is separated from said transfer material bearing member to a time when the separation of the transfer material is finished.

3. An image forming apparatus according to claim 1, wherein plural color images can be formed on said image bearing member, and the plural color images are transferred superimposedly onto the same transfer material born by said transfer material bearing member.

4. An image forming apparatus according to claim 3, wherein, whenever each color image among the plural color images is transferred to the same transfer material, said voltage is increased.

5. An image forming apparatus according to claim 4, wherein a constant voltage is applied to said conductive member during a time period from the transferring of the last color image among the plural color images to be transferred to the same transfer material, to a time when the separation of the same transfer material from said transfer material bearing member is finished.

6. An image forming apparatus according to claims 1, 2, or 5 wherein a single position for bearing a tip end of the transfer material by said transfer material bearing member in the rotational direction of said transfer material bearing member is provided.

7. An image forming apparatus according to claim 6, wherein said transfer material bearing member has a gripper means for holding the tip end of the transfer material.

8. An image forming apparatus according to claim 6, wherein, when images are formed on first and second transfer materials, a distance between the first transfer material and the second transfer material along a transfer material convey path is shorter than said length L1.

9. An image forming apparatus according to claim 1, wherein, when images are formed on first and second transfer materials, a distance between the first transfer material and the second transfer material along a transfer material convey path is shorter than said length L1.

10. An image forming apparatus according to claim 1, wherein said transfer material bearing member further comprises an elastic member provided between the sheet member and said conductive member.

11. An image forming apparatus according to claim 10, wherein said elastic member is a sponge.

12. An image forming apparatus according to claim 1, wherein a relation $0 \leqq L \leqq L1/5$ is satisfied.

13. An image forming apparatus according to claim 9, wherein the voltage is decreased during a time period from the end of the separation of the first transfer material from said transfer material bearing member to the start of the first transferring to the second transfer material.

14. An image forming apparatus according to claim 3, wherein a full-color image is formed on the transfer material.

15. An image forming apparatus according to claim 1, 2, 5, 10, 11 or 12, wherein during the image formation to the first and second transfer materials whose length in rotational direction of said transfer material bearing member is $H_{max}$, a distance between the first transfer material and the second transfer material along the transfer material convey path is L–Hmax).

16. An image forming apparatus according to claim 15, wherein, in a rotational direction of said transfer material bearing member, said transfer material bearing member bears a tip end of the transfer material at one position.

17. An image forming apparatus according to claim 16, wherein said transfer material bearing has gripper means for holding the tip end of the transfer material.

18. An image forming apparatus according to claim 15, wherein the voltage is decreased during a time period from the end of separation of the first transfer material from said transfer material bearing member until the start of first image transfer to the second transfer material.

19. An image forming apparatus, comprising:

an image bearing member for bearing an image thereon; and a transfer material bearing member rotatable for bearing a transfer material, the image on said image bearing member being transferred onto the transfer material born by said transfer material bearing member at a transfer position, and a voltage being applied to said transfer material bearing member during the transferring operation to the transfer material;

characterized by that when defining a distance between said transfer position and a separation position where the transfer material is separated from said transfer material bearing member along a peripheral surface of said transfer material bearing member in a rotational direction of said transfer material bearing member as L, a whole circumferential length of said transfer material bearing member as L1, and lengths of the transfer materials of small size and large size usable in said image forming apparatus in the rotation direction of said transfer material bearing member as $H_{min}$, $H_{max}$ where, $L \leqq (L1-H_{min})$, $L>(L1-H_{max})$ is satisfied respectively, and when the images are continuously formed on first and second transfer materials, a time period after finish of separation of the first transfer material from said transfer material bearing member until the second transfer material reaches the transfer position in case of the transfer material of a small size is shorter than that in case of the transfer material of a large size.

20. An image forming apparatus according to claim 19, wherein said transfer material bearing member comprises a sheet member for bearing the transfer material, and a conductive member disposed at a side of the sheet member opposite to a side where said sheet member bears the transfer material and to which the voltage is applied.

21. An image forming apparatus according to claim 20, wherein the constant voltage is applied to said conductive member during a time period from the transferring of the last color image among the plural color images to be transferred to the same transfer material, to a time when the separation of the same transfer material from said transfer material bearing member is finished.

22. An image forming apparatus according to claim 19, wherein plural color images can be formed on said image bearing member, and the plural color images are superimposedly transferred onto the same transfer material born by said transfer material bearing member.

23. An image forming apparatus according to claim 22, wherein whenever each color image among the plural color images are transferred to the same transfer material, the voltage is increased.

24. An image forming apparatus according to claim 23, wherein said transfer material bearing member comprises a sheet member for bearing the transfer material, and a conductive member disposed at a side of the sheet member opposite to a side where said sheet member bears the transfer material and to which the voltage is applied.

25. An image forming apparatus according to claim 24, wherein the constant voltage is applied to said conductive member during a time period from when the transferring of the last color image among the plural color images to be transferred to the same transfer material, to a time when the separation of the same transfer material from said transfer material bearing member is finished.

26. An image forming apparatus according to claim 19, 21 or 25, wherein a single position for bearing a tip end of the transfer material by said transfer material bearing member in the rotational direction of said transfer material bearing member is provided.

27. An image forming apparatus according to claim 26, wherein said transfer material bearing member has gripper means for holding the tip end of the transfer material.

28. An image forming apparatus according to claim 26, wherein, when images are formed on first and second transfer materials, a distance between the first transfer material and the second transfer material is shorter than said length L1 in case of the transfer material of small size, and is longer than said length L1 in case of the transfer material of large size.

29. An image forming apparatus according to claim 28, wherein when using the transfer material of small size, a distance between the first transfer material and the second transfer material along the transfer material convey path is $(L1-H_{min})$.

30. An image forming apparatus according to claim 19, wherein, when the images are continuously formed on first and second transfer materials, a distance between the first transfer material and the second transfer material is shorter than said length L1 in case of the transfer material of small size, and is longer than said length L1 in case of the transfer material of a large size.

31. An image forming apparatus according to claim 30, wherein when using the transfer material of the small size, a distance between the first transfer material and the second transfer material along the transfer material convey path is $(L1-H_{min})$.

32. An image forming apparatus according to claim 20, wherein said transfer material bearing member further comprises an elastic member provided between the sheet member and said conductive member.

33. An image forming apparatus according to claim 32, wherein said elastic member is a sponge.

34. An image forming apparatus according to claim 19, wherein a relation $O \leqq L \leqq L1/5$ is satisfied.

35. An image forming apparatus according to claim 29, wherein said voltage is decreased during a time period from the end of the separation of the first transfer material from said transfer material bearing member to the start of the first transferring to the second transferring material.

36. An image forming apparatus according to claim 31, wherein said voltage is decreased during a time period from the end of the separation of the first transfer material from said transfer material bearing member to the start of the first transferring to the second transfer material.

37. An image forming apparatus according to claim 29, wherein, in case of the transfer material of a large size, immediately after the tip end of the first transfer material is separated from said transfer material bearing member, when the position for bearing the tip end of the transfer material by said transfer material bearing member reaches a position where the transfer material is conveyed to said transfer material bearing member, the second transfer material is not conveyed to said transfer material bearing member.

38. An image forming apparatus according to claim 31, wherein, in case of the transfer material of a large size, immediately after the tip end of the first transfer material is separated from said transfer material bearing member, when the position for bearing the tip end of the transfer material by said transfer material bearing member reaches a position where the transfer material is conveyed to said transfer material bearing member, the second transfer material is not conveyed to said transfer material bearing member.

39. An image forming apparatus, comprising:

an image bearing member for bearing an image thereon; and a rotatable transfer material bearing member for bearing a transfer material, said transfer material bearing member comprising a sheet member for bearing the transfer material, and a conductive member disposed at a side of the sheet member opposite to a side where said sheet member bears the transfer material and to which a voltage is applied for transferring the image on said image bearing member to the transfer material born on said sheet member at the transfer position during the transferring operation to the transfer material;

wherein defining that a whole circumferential length of said transfer material bearing member is L1, and a length of the transfer material in the rotational direction of the transfer material bearing member is H, when effecting the image formation to first and second transfer materials continuously with a gap of (L1–H) therebetween, the second transfer material reaches the transfer position after separation of the first transfer material from said transfer material bearing member is complete, regardless of the length of the first and second transfer material in the rotational direction.

40. An image forming apparatus according to claim 39, wherein the constant voltage is applied to said conductive member during a time period from immediately before the transfer material is separated from said transfer material bearing member to a time when the separation of the transfer material is complete.

41. An image forming apparatus according to claim 39, wherein plural color images can be formed on said image bearing member, and the plural color images are superimposedly transferred onto the same transfer material born by said transfer material bearing member.

42. An image forming apparatus according to claim 41, wherein, whenever each color image among the plural color images is transferring to the same transfer material, said voltage is increased.

43. An image forming apparatus according to claim 42, wherein the constant voltage is applied to said conductive member during a time period from the transferring of the last color image among the plural color images to be transferred to the same transfer material, to a time when the separation of the same transfer material from said transfer material bearing member is complete.

44. An image forming apparatus according to claim 39, 40 or 43 wherein a single position for bearing a tip end of the transfer material by said transfer material bearing member in the rotational direction of said transfer material bearing member is provided.

45. An image forming apparatus according to claim 44, wherein said transfer material bearing member has gripper means for holding the tip end of the transfer material.

46. An image forming apparatus according to claim 39, wherein said transfer material bearing member further comprises an elastic member provided between the sheet member and said conductive member.

47. An image forming apparatus according to claim 46, wherein said elastic member is a sponge.

48. An image forming apparatus according to claim 39, wherein a relation $0 \leqq L \leqq L1/5$ is satisfied.

49. An image forming apparatus according to claim 39, wherein the voltage is decreased during a time period from the end of the separation of the first transfer material from said transfer material bearing member to the start of the first transferring to the second transfer material.

50. An image forming apparatus according to claim 41, wherein a full-color image is formed on the transfer material.

* * * * *

UNITED STATES PATENT AND TRADEMARK OFFICE

CERTIFICATE OF CORRECTION

PATENT NO. : 5,539,507

DATED : July 23, 1996

INVENTOR(S) : TOSHIAKI MIYASHIRO, ET AL.

It is certified that error appears in the above-indentified patent and that said Letters Patent is hereby corrected as shown below:

Column 1,
line 10, "born" should read --borne--;
line 52, "1a," should read --31a,--;
line 56, "1c" should read --31c,--; and
line 65, "a" should read --an--.

Column 3,
line 22, "in" (1st occurrence) should read --in the--; and
line 26, "is" should read --is(are)--.

Column 5,
line 1, "born" should read --borne--;
line 3, "a" should read --an--;
line 4, "absorbing" should read --attracting--; and
line 32, "from" should read --drum--.

Column 6,
line 43, "In" should read --In the--.

Column 7,
line 29, "in" should read --in the--; and
line 67, "In" should read --In the--.

Column 8,
line 26, "in" should be deleted;
line 37, "$0<L<L1/5$." should read --$0 \leq L \leq L1/5$.--;
line 41, "being" should read --bearing--; and
line 50, "in" should read --in the--.

Column 10,
line 17, "born" should read --borne--;
line 30, "$L \leq (L1-Hmax)$" should read --$L \leq (L1-H_{max})$--, and
line 40, "born" should read --borne--.

UNITED STATES PATENT AND TRADEMARK OFFICE

CERTIFICATE OF CORRECTION

PATENT NO. : 5,539,507
DATED : July 23, 1996
INVENTOR(S) : TOSHIAKI MIYASHIRO, ET AL.

It is certified that error appears in the above-indentified patent and that said Letters Patent is hereby corrected as shown below:

Column 11,
line 25, "(L-Hmax)." should read --(L-$H_{max}$).--;
line 31, "bearing" should read --bearing member--; and
line 45, "born" should read --borne--.
Column 12,
line 17, "born" should read --borne--; and
line 21, "are" should read --is--.
Column 13,
line 47, "born" should read --borne--.
Column 14,
line 16, "born" should read --borne--.

Signed and Sealed this

Nineteenth Day of November, 1996

*Attest:*

Bruce Lehman

BRUCE LEHMAN

*Attesting Officer*

*Commissioner of Patents and Trademarks*